US005961432A

United States Patent [19]

Murakami et al.

[11] Patent Number: 5,961,432

[45] Date of Patent: Oct. 5, 1999

[54] FORGERY PREVENTIVE SHEET AND METHOD OF MANUFACTURING SAME

[75] Inventors: Toru Murakami, Mishima; Youichi Fujimoto, Susono; Tadahiro Iwasaki, Suntou-gun, all of Japan

[73] Assignee: Tokushu Paper Mfg. Co., Ltd., Shizuoka, Japan

[21] Appl. No.: 08/945,608

[22] PCT Filed: Mar. 7, 1997

[86] PCT No.: PCT/JP97/00719

§ 371 Date: Nov. 3, 1997

§ 102(e) Date: Nov. 3, 1997

[87] PCT Pub. No.: WO97/34048

PCT Pub. Date: Sep. 18, 1997

[30] Foreign Application Priority Data

Mar. 12, 1996 [JP] Japan ..... 8-001625 U
May 29, 1996 [JP] Japan ..... 8-135244

[51] Int. Cl.[6] ..... B31B 1/88

[52] U.S. Cl. ..... 493/187; 493/188; 283/113; 162/110; 162/140; 162/108

[58] Field of Search ..... 283/113, 901; 162/108, 110, 116, 117, 109, 103, 140; 493/187, 188

[56] References Cited

U.S. PATENT DOCUMENTS 4,504,357 3/1985 Holbein et al. ..... 162/140
5,161,829 11/1992 Detrick et al. ..... 283/901
5,388,862 2/1995 Edwards ..... 283/901
5,405,500 4/1995 Knight ..... 162/103
5,516,153 5/1996 Kaule ..... 283/901
5,567,276 10/1996 Boehm et al. ..... 162/103
5,573,639 11/1996 Schmitz et al. ..... 162/140
5,660,919 8/1997 Vallee et al. ..... 162/140

*Primary Examiner*—James F. Coan
*Assistant Examiner*—Gene L. Kim
*Attorney, Agent, or Firm*—Wenderoth, Lind & Ponack, L.L.P.

[57] ABSTRACT

Anti-falsification paper is provided in which a thread is exposed at window portions provided on the surface of the paper, and which does not produce any cockles even when wound up continuously in a roll and has good appearance in terms of design. This anti-falsification prevention paper is combination paper having at least two paper layers including an outermost layer and an inner layer. Window portions are formed in the outermost layer at intervals in a longitudinal direction of the paper. In the window portions there are formed watermarks of letters or pictures, and a thread inserted between the outermost layer and the other layer is exposed at these window portions. The ratio between the length (X) of the window portions in the longitudinal direction of the paper and the length (Y) in the same direction of non-window portions between the window portions is set at 3:1 to 1:2 to securely prevent the formation of cockles during the winding of paper. This setting of the length ratio of the window portions to the non-window portions also offers desirable effects on the design.

17 Claims, 3 Drawing Sheets

FORGERY PREVENTIVE SHEET AND METHOD OF MANUFACTURING SAME

FIELD OF THE INVENTION

The present invention relates to anti-falsification paper and a method of manufacture thereof, and more specifically to anti-falsification paper, called "thread-inserted, window paper," in which a thread inserted between combined paper layers making up the anti-falsification paper is exposed at windows provided in the outermost paper layer, and to a method of making such anti-falsification paper.

BACKGROUND ART

Anti-falsification paper called "thread-inserted paper" is well known, in which an elongate element is inserted in the thickness of the paper. A typical example of the elongate element is a thread described hereinbelow. Paper with inserted threads requires very sophisticated technologies to manufacture and thus has a significant effect for anti-falsification. It is therefore widely used for making bank notes in many countries.

Thread-inserted paper may be classified largely into two categories. The first is the paper which has an elongate element embedded therein so that it is not exposed to the surface of the paper. The second is the one called "thread-inserted, window paper," in which a part of the inserted elongate element is exposed to the surface of the paper.

A variety of methods have been proposed for making the first category of paper. They include a method disclosed in Japanese Patent Laid-Open Specification No. 51-130309/1976, in which a nozzle is laid in the flow of paper stock in a slice portion of a Fourdrinier paper machine and an elongate element is supplied through the nozzle along with running water so as to be embedded in a web deposited on a wire cloth. A method is disclosed in Japanese Patent Laid-Open Specification No. 2-169790/1990, in which an elongate element incorporating device is used to incorporate an elongate element into the paper stock flowing from a flow box of a Fourdrinier paper machine by supplying the elongate element with an air flow that keeps the elongate element and the stock out of contact with each other. Also a method is disclosed in Japanese Patent Publication No. 5-40080/1993, in which a cylinder paper machine having two or more vats is used to combine two or more paper layers and an elongate element is fed from a pipe having projections and recesses in its inner wall to be inserted between the paper layers.

As the methods of making the second category of paper, the "thread-inserted, window paper", there is proposed a method disclosed in Japanese Patent Publication No. 5-85680/1993, in which a grooved belt mechanism with an elongate element passed through a raised end of a guide having recessed and raised portions is immersed in a suspension of paper stock on wire cloth. A method is disclosed in U.S. Pat. No. 4,462,866, in which a wire mesh having raised portions is used for a face wire of a cylinder paper machine and an elongate element is incorporated in the thickness of paper as the elongate element is fed in contact with the raised portions of the wire mesh so that the elongate element is incorporated in paper and exposed at window portions. Also, a method is disclosed in Japanese Patent Specification Laid-Open No. 6-272200/1994, in which a compressed air nozzle is installed in a rotating drum of wire cloth in a Fourdrinier paper machine to intermittently blow away pulp slurry deposited over an elongate element embedded in web so that the elongate element is exposed.

"Watermarked paper" having watermarks of letters or pictures also requires a high level of technology to manufacture and has long been used for anti-falsification. Because the anti-falsification effectiveness increases with the number of anti-falsification means employed in the anti-falsification paper, a variety of anti-falsification paper has been developed which combine the above-mentioned "thread-inserted, window paper" technology with the "watermarking" technology. One such example is sterling notes used in England, which has thread-inserted windows at predetermined locations and a watermarked portrait at a different location.

This conventional paper has a common drawback that the paper cannot be rolled up in a great length. Because the thread normally has a thickness of several tens of micrometers and is continuously inserted or embedded at a particular position of the paper, when the paper is rolled up, the paper thickness at the location where the thread is inserted progressively increases until cockles are produced at that location. Our investigation has found that when a thread of about 15 $\mu$m thick is continuously inserted in paper of 100 g/m$^2$, rolling about 1000 meters of the paper results in cockles being produced at the thread inserted location. Once cockles are produced, the paper rolled up thereafter is not adequate for use. Whether the paper can be wound up in a roll has a great effect on productivity at a later process where the paper will be subjected to printing, since the paper must be bundle-finished if it cannot be rolled up.

In anti-falsification paper that uses the "thread-inserted, window paper" technology and the "watermarking" technology at different locations, printing is difficult to be performed at the "thread-inserted, window" portion and the "watermarked" portion. If they are to be printed, only very light colors can be used. This reduces the area on paper where decorative printing can be made, giving rise to limitations on the designs which can be printed.

SUMMARY OF THE INVENTION

The present invention has been accomplished to provide novel and improved anti-falsification paper that can eliminate the conventional problems described above and also a method of manufacturing such anti-falsification paper.

The cause of cockles formed when winding the thread-inserted paper in a roll during the process of manufacture of the paper is that the thickness of paper locally increases because of the inserted or embedded thread as described above. The inventors of this invention have conducted studies under the assumption that cockles could be eliminated if the paper thickness was partially reduced in such a way as to offset the localized increase in paper thickness. The inventors have found that the above problem can be solved by providing in the paper surface window portions of particular size whose paper thickness is reduced and inserting a thread so that it is exposed in these window portions. With this method, however, when the paper is held to the light, the windows as a whole look white and transparent giving unnatural impressions. The inventors conducted further research and found that this drawback can be eliminated by watermarking letters or pictures in the window portions and that restrictions on the printing design can be eliminated by forming both the "thread-inserted window" portions and the "watermarked" portions in the same locations in the paper. Forming watermarks in the window portions prevents the paper thickness of the entire window portions from becoming small, which in turn effectively prevents the formation of cockles when winding the paper in a roll.

The anti-falsification paper of this invention comprises combination paper having at least two paper layers including an outermost layer and an innermost layer. Window portions are provided in the outermost layer so that they are arranged at intervals along a longitudinal direction of the outermost layer. Watermarks of letters or pictures are formed in the window portions and a thread is inserted between the outermost layer and the other layer. The thread is exposed at the window portions.

At this time, the ratio between the length (X) of the window portions in the longitudinal direction of the paper and the length (Y) in the same direction of non-window portions between the window portions is set at 3:1 to 1:2 to thereby securely prevent the formation of cockles when winding the paper continuously in a roll and also to offer preferable effect on the design on the paper surface.

The method of manufacturing the above anti-falsification paper according to this invention comprises the steps of:

in making combination paper having at least two paper layers including an outermost layer and an inner layer by using a cylinder paper machine provided with multiple vats;

(a) forming the other layer in a vat in front of a final vat and then forming in the final vat the outermost layer having window portions arranged at intervals in a direction of flow of the paper layer and also having watermarks of letters or pictures in the window portions; or (b) forming in a first vat the outermost layer having window portions arranged at intervals in a direction of flow of the paper layer and also having watermarks of letters or pictures formed in the window portions, and then forming in a second or subsequent vat the inner layer; and immediately before putting the outermost layer and the inner layer together, inserting a thread between the layers so that the thread runs through the window portions of the outermost layer;

whereby combination paper is produced, in which the watermarks are formed in the window portions of the outermost layer and the thread is exposed at the window portions.

BEST MODE FOR CARRYING OUT THE INVENTION

Figure 1:
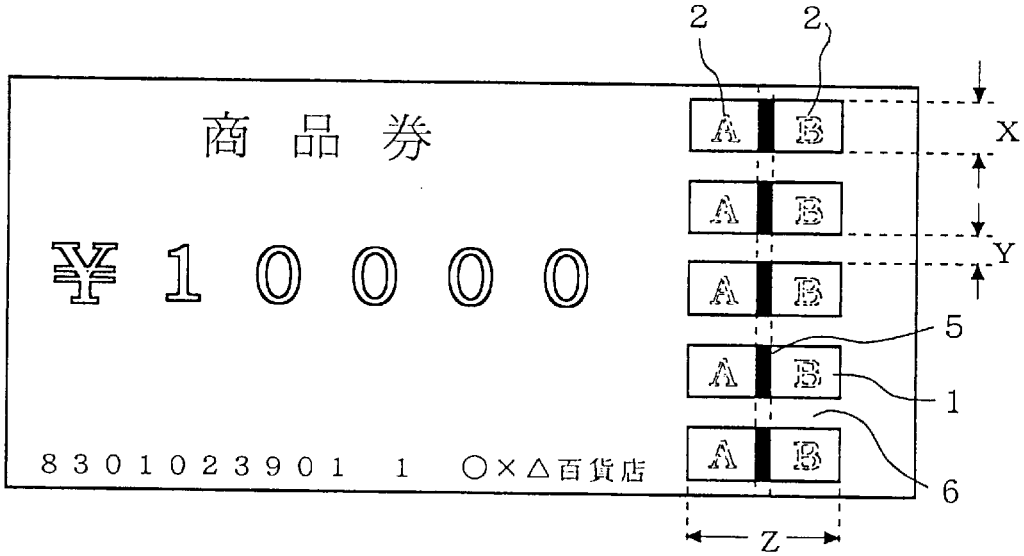
FIG. 1 is a plan view of an example of a gift certificate that uses anti-falsification paper of this invention.
Figure 2:
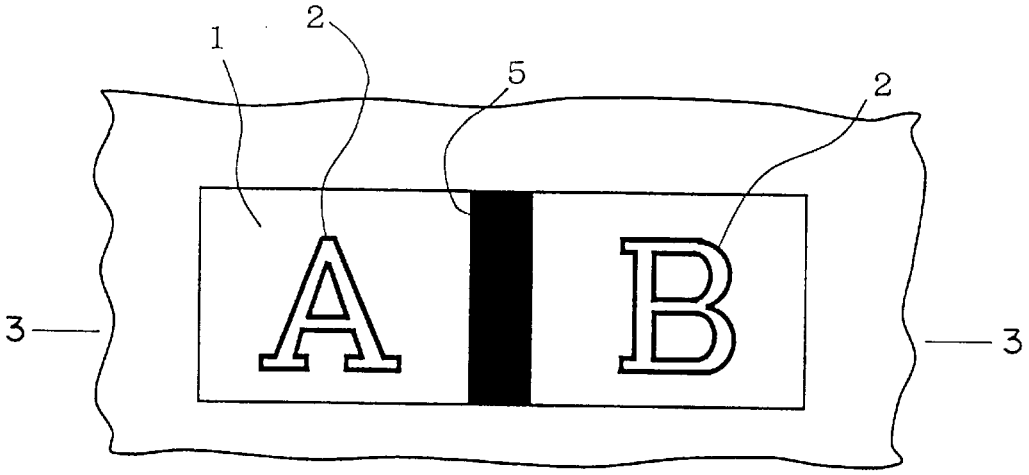
FIG. 2 is an enlarged view of a window portion of FIG. 1 as seen from above.
Figure 3:
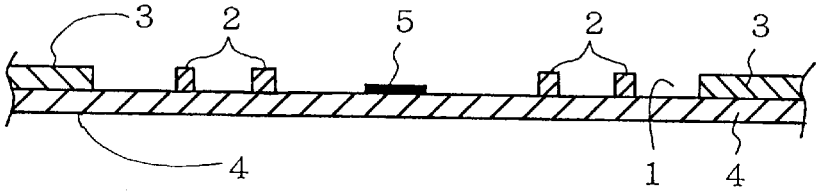
FIG. 3 is an end view cut along the line 3—3 of FIG. 2.

The anti-falsification paper of this invention will be described by taking an example of a gift certificate that uses the anti-falsification paper comprising combination paper having two paper layers, as shown in FIGS. 1, 2 and 3. The anti-falsification paper shown has two paper layers, an outermost layer 3 and another or inner layer 4, and the outermost layer 3 has window portions 1 intermittently arranged in a longitudinal direction (i.e., the flow direction of the paper layer during paper making), with watermarks 2 of letters or pictures in the window portions 1. A thread 5 is inserted between the outermost layer 3 and the layer 4 adjacent thereto and is exposed at the window portions 1.

This invention also provides a method of securely and efficiently making anti-falsification paper of such a construction as described above.

In practicing the method of making the anti-falsification paper of this invention, a paper stock must first be prepared. The stock is made by mixing and beating an appropriate ratio of wood pulps such as conifer bleached kraft pulp (NBKP), broad-leaved tree bleached kraft pulp (LBKP) and conifer bleached sulfite pulp (NBSP) and non-wood pulps such as hemp, cotton and straw, and adding appropriate amounts of filler, dry paper strength agent, wet paper strength agent, sizing agent, fixing agent, retention aid, drainage aid, antifoaming agent, dye, coloring pigment, fluorescent agent, etc. until the freeness is adjusted ordinarily to 400–250 ml C.S.F.

Figure 4:
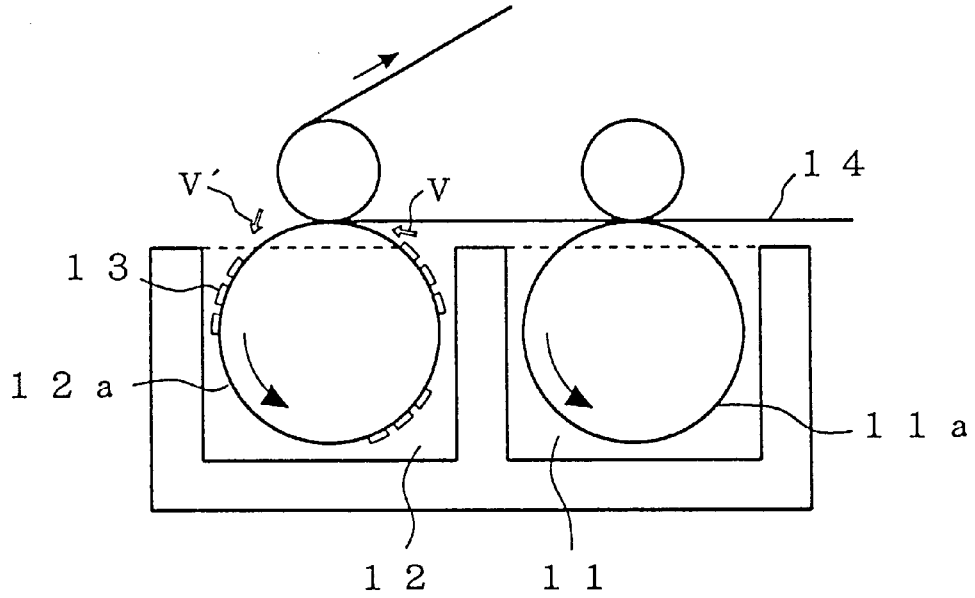
FIG. 4 is a schematic view showing a cylinder paper machine provided with multiple vats that can suitably be used for the method of this invention.

In making combination paper having two or more paper layers, a cylinder paper machine provided with multiple vats is generally used. This invention, too, can use such a cylinder paper machine. FIG. 4 shows a cylinder paper machine provided with two vats 11, 12 used to form combination paper having two paper layers 3, 4 (FIG. 3). This machine includes a first vat 11 (in front of a final vat) to form a paper layer 4, which has neither window portions 1 nor watermarks 2, and a second vat 12 (final vat) for forming an outermost paper layer 3 having window portions 1 and watermarks 2.

Figure 5:
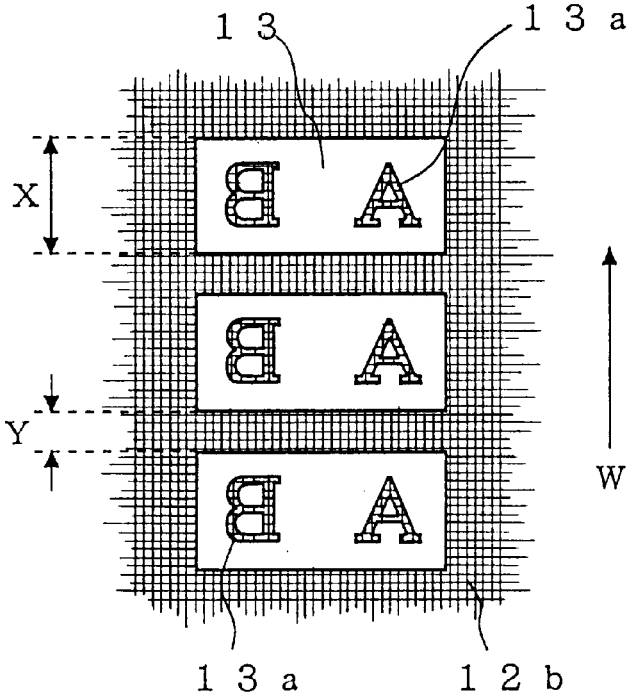
FIG. 5 is a partial schematic view showing a mold for making window portions and watermarks, mounted on a face wire of a cylinder used in the cylinder paper machine of FIG. 4.

The cylinder 12*a* in the vat 12 has a face wire 12*b* to which is attached by a fine metal wire, solder or bonding agent a mold 13, as shown in FIG. 5, that corresponds to the window portion 1 and is made of metal, resin or paper. Although the mold 13 corresponding to the window portion is rectangular in the illustrated example, it may be formed in the shape of a square, circle or oval or in other desired shapes. The mold 13 is provided with perforated portions 13*a* that are formed by through-holes to make watermarks 2 of letters or pictures.

In mounting the molds 13 of FIG. 5 to the face wire 12*b* of the cylinder dipped in the vat 12 for making the outermost layer 3, it is desirable that the molds 13 are spaced from each other so that the ratio of a length X of the window portion 1 in the direction of flow of the paper layer (longitudinal direction of paper) indicated by an arrow W to a length Y in the same direction of a non-window portion 6 between the window portions is set in a range of between 3:1 and 1:2. The reason why the space ratio of the window portion 1 is set in this range is that this range of the space ratio ensures the above-mentioned cockle prevention effect when winding the paper in a roll and also is desirable in terms of design on the paper surface.

The cylinder 11*a* in the vat 11 of the cylinder paper machine of FIG. 4 is provided with a face wire onto which no mold is mounted. The paper layer 4 deposited on the cylinder 11*a* having the mold-free face wire is transferred onto a blanket 14 and then carried to the cylinder 12*a*, which is mounted with the molds 13 and dipped in the vat 12, where the outermost layer 3 formed by the cylinder 12*a* is stacked on the first layer 4 to form a two-layer combined sheet. A thread 5 is inserted at a location indicated by an arrow V immediately before the layer 4 and the layer 3 are combined together. It may be inserted at a location indicated by an arrow V' before the cylinder 12*a* goes into a suspension of paper stock in the vat 12. The methods of inserting the thread 5 include one in which the thread is fed through a supply pipe having projections and recesses in its inner wall, as proposed by the above-mentioned Japanese Patent Publication No. 5-40080/1993 filed by the same applicant of this application, a method proposed by the above-mentioned U.S. Pat. No. 4,462,866, and the like.

Although the molds 13 attached to the cylinder 12*a* are shown simplified only at scattered locations in FIG. 4, it is understood that they actually are attached to the entire circumference of the cylinder 12*a* in a spaced configuration.

By using the above-described method of this invention, the anti-falsification paper of a configuration shown in FIGS. 1 to 3 can be manufactured. That is, the outermost paper layer 3 deposited on the cylinder 12*a* having the molds 13 is formed with window portions 1 that are not deposited with paper stock at locations corresponding to the molds 13 and in which are formed watermarks 2 of letters or pictures deposited with the paper stock. The thread 5 is inserted between the paper layers 3 and 4 so that it runs through the window portions 1. Hence, the thread 5 is exposed at window portions 1 and embedded between the layers 3 and 4 at the non-window portions 6.

In the method of manufacturing anti-falsification paper according to this invention, it is possible to apply starch, polyvinyl alcohol and various surface sizing agents to the paper surface by using a size press device and the like during paper making. Further, the paper may by subjected to machine calender treatment or super calender treatment, as required, to improve surface smoothness.

The thread 5 used in this invention may include a variety of threads conventionally proposed for anti-falsification, such as gold-silver thread, hologram thread, magnetic thread, fluorescent thread and the like. The gold-silver thread, for example, is made by vacuum-evaporating and depositing metal aluminum over a polyester film, applying a protective resin coating to the aluminum-deposited surface, and slitting it into a thread by a micro-slitter. By coloring the protective resin coating in yellow, the thread thus formed has a golden color. The thread is preferably applied with a heat sensitive adhesive, which is activated by heat in the dry zone in the paper making machine to make the adhesion between the thread and the paper more secure.

As to the dimension of the mold 13 attached to the cylinder 12*a* of this invention, the length X in the direction of flow W of the paper layer shown in FIG. 5 is preferably set to 5–30 mm and the lateral length Z shown in FIG. 1 perpendicular to the flow direction to 10–50 mm. This size of the mold 13 corresponds to that of the window portion 1 of the paper shown in FIG. 1. When the window portion 1 is smaller than this range, the letters or pictures watermarked in the window portion 1 become too small. Also, when the window portion 1 is larger than this range, the exposed length of the thread 5 becomes too long, degrading the appearance in terms of balance of design.

The anti-falsification paper of this invention is manufactured ordinarily at a basis weight of 70–150 g/m$^2$. The ratio of combination or combination ratio between the outermost paper layer and the inner paper layer is preferably set in a range of between 20:80 and 80:20. When, for example, two-layer combination paper with a basis weight of 100 g/m$^2$ has a combination ratio of 20:80, this means that the paper comprises 20 g/m$^2$ of the outermost paper layer and 80 g/m$^2$ of the other paper layer. If the combination ratio of the outermost layer is less than 20, the watermarked letters or pictures likely fail to be defined clearly. When the combination ratio exceeds 80, the watermarks will easily collapse.

Figure 6:
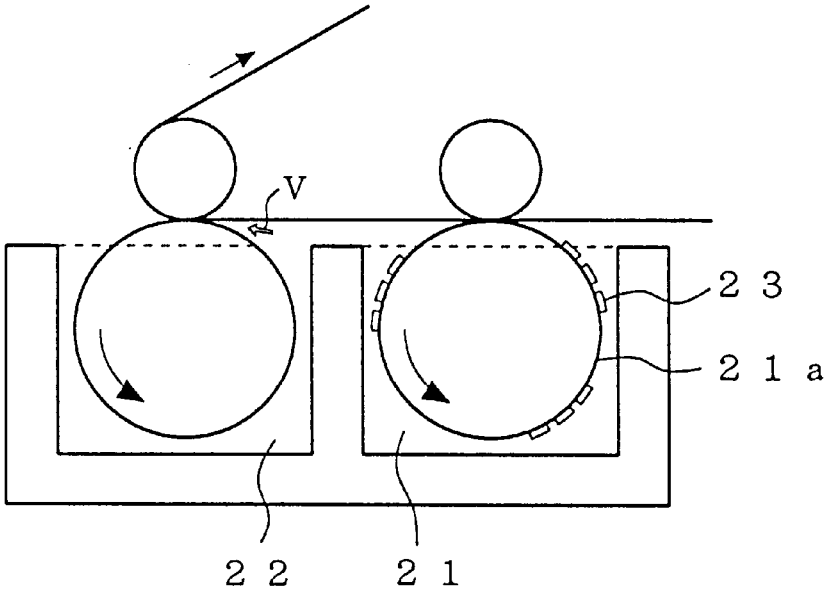
FIG. 6 is a schematic view showing another example of the cylinder paper machine provided with multiple vats that can suitably be applied for the method of this invention.
Figure 7:
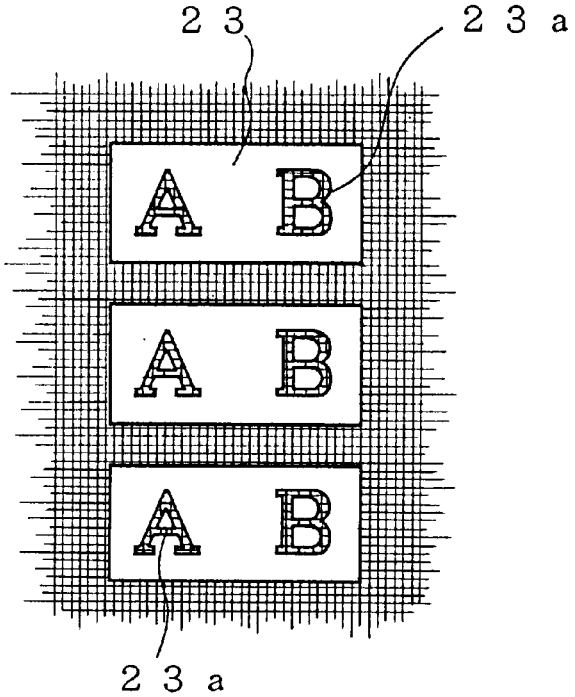
FIG. 7 is a partial schematic view showing a mold for making window portions and watermarks, mounted on a face wire of a cylinder used in the cylinder paper machine of FIG. 6.

In the above-described example of the method of this invention, a plain paper layer with no windows or watermarks is formed in the first vat 11 (in front of the final vat), and then the outermost layer having the window portions and the watermarks is formed in the second vat 12 (the final vat), as shown in FIG. 4. This method, however, may be transformed into the configuration shown in FIG. 6, in which the outermost paper layer having the window portions and the watermarks is formed in the first vat 21 and the plain paper layer is formed in the second vat 22 (final vat). In this case, the molds 23 for forming the window portions and watermarks are attached to the entire circumference of the face wire of the cylinder 21*a* in the first vat 21 by a means similar to the one described above. Perforated portions 23*a* in the molds 23 used to watermark letters or pictures are, as shown in FIG. 7, reversed from those shown in FIG. 5.

EXAMPLE 1

Preparation of stock 20 parts by weight of NBKP and 80 parts by weight of LBKP were mixed and beaten into slurry having 350 ml C.S.F., to which were added 10 parts by weight of china clay, 0.3 parts by weight of paper strength agent (trade name "Polystron 191" manufactured by Arakawa Kagaku Kogyo K.K.), 1.0 part by weight of sizing agent (trade name "Sizepine E" manufactured by Arakawa Kagaku Kogyo K.K.) and an appropriate amount of aluminum sulphate to prepare paper stock.

Manufacture of wire cloth

A number of resin plates, 10 mm wide by 25 mm long by 0.3 mm thick, were prepared. They were perforated at portions 13*a* 1.2 mm wide to form letters "A" and "B" and these perforated portions were arranged at equal intervals to form the molds 13 (FIG. 5). Then, the face wire 12*b* (1300 mm wide) of the cylinder of the cylinder paper machine was bonded with the molds 13 of resin plates by using an adhesive, so that the molds were arranged in line at 5 mm intervals in the direction of flow W of the paper layer. Six such lines of molds were arranged on the face wire 12*b* at equal intervals in the lateral direction.

Paper forming

In the cylinder paper machine having two vats as shown in FIG. 4, the cylinder 11*a* in the first vat is provided with a face wire that has no mold while the cylinder 12*a* in the second vat is mounted with a face wire 12*b* having the molds 13. The above-described paper stock was deposited on these wires at the rate of 50 m/min. to form a first paper layer 4 from the first vat and a second paper layer 3 (outermost layer) from the second vat, with the second layer overlying the first layer to form a two-layer combined sheet. During this process, a gold-silver thread 1.0 mm wide and 15 $\mu$m thick was inserted between the first layer (a dry weight equivalent of 50 g/m$^2$) and the second layer (a dry weight equivalent of 50 g/m$^2$) at a location corresponding to the center of the molds 13 by using a method proposed in the above-described Japanese Patent Publication No. 5-40080/1993. Next, the wet web was dewatered in the ordinary way and then dried by a cylinder drier, thus forming the anti-falsification paper made of two-layer combination paper. The paper thus formed was found to have window portions 1 whose length X in the longitudinal direction of the paper is 10 mm and the non-window portions 6 whose length Y in the same direction is 5 mm, with letters "A" and "B" 1.2 mm wide watermarked in the window portions 1 and with the thread 5 exposed at the window portions 1 and embedded between the paper layers at the non-window portions 6. When the paper was wound in a roll by a winder of the paper making machine, no cockles formed even after 6000 meters of paper had been wound.

INDUSTRIAL APPLICABILITY OF THE INVENTION

According to the method of this invention described above and the anti-falsification paper produced with this method, the following significant advantages are obtained.

1) Because the watermarked letters or pictures 2 and the exposed portion of the thread 5 are both located inside the window portions 1, the anti-falsification paper has good appearance in terms of design. When the paper is subjected to printing, the limitation on the design to be printed that arises when the watermarks 2 and the exposed portions of the thread 5 are formed in different locations can be eliminated. Such limitation includes, for example, a problem that the printing area is reduced when printing of a decorative design is desirable.

2) When the paper is wound continuously in a roll by the winder of the paper making machine, this invention can prevent the formation of cockles, which would otherwise be produced due to localized increase in paper thickness caused by the inserted thread. This permits the use of a rotary printing machine to print the rolled paper, making a significant improvement in printing efficiency over the use of bundle-finished paper.

3) When securities and the like made of this paper are stacked up in large numbers, the stack can be handled easily and will not easily collapse because there is no localized bulge at the thread-inserted portion. Similarly, when a large number of securities are stacked for automatic OCR reading machine, easy handling is assured as they have no localized bulge at the thread-inserted portion.

Because of these advantages, the anti-falsification paper of this invention can be suitably applied to bank notes, checks, stock certificates, bonds, gift certificates, cards, confidential documents, passports, identification cards, etc.

We claim:

1. Anti-falsification paper comprising:

combination paper having at least two paper layers which include an outermost layer and an inner layer, said outermost layer including a plurality of window portions arranged at intervals along a longitudinal direction of said outermost layer, and a plurality of watermarks formed in said window portions, respectively; and a thread inserted between said outermost layer and said inner layer such that said thread is exposed at said window portions which extend laterally beyond opposing longitudinal edges of said thread.

2. The anti-falsification paper as claimed in claim 1, wherein said watermarks are of letters or pictures.

3. The anti-falsification paper as claimed in claim 1, wherein said window portions are spaced by non-window portions, and a ratio of a dimension (X) of said window portions in the longitudinal direction of said outermost layer to a dimension (Y) of said non-window portions in the longitudinal direction of said outermost layer located between said window portions is 3:1 to 1:2.

4. The anti-falsification paper as claimed in claim 1, wherein a dimension of each of said window portions in the longitudinal direction of said combination paper is 5–30 mm, and a dimension of each of said window portions in a widthwise direction of said combination paper is 10–50 mm.

5. The anti-falsification paper as claimed in claim 1, wherein a combination ratio between said outermost layer and said inner layer is 20:80 to 80:20.

6. A method of making anti-falsification paper with a cylinder paper machine having a plurality of vats, said method comprising:

forming an inner paper layer in a vat disposed in front of a final vat;

forming, in the final vat, an outermost paper layer having window portions arranged at intervals along a longitudinal direction of said outermost paper layer;

forming watermarks in said window portions;

inserting a thread between said outermost paper layer and said inner paper layer so that said thread is exposed through said window portions of said outermost paper layer, wherein said windows extend laterally beyond longitudinal edges of said thread; and putting together said outermost paper layer and said inner paper layer, after inserting said thread, to form combination paper having at least two paper layers including said outermost layer and said inner layer, wherein said watermarks are formed in said window portions of said outermost paper layer and said thread is exposed at said window portions.

7. The method of making anti-falsification paper as claimed in claim 6, wherein said watermarks are formed with a plurality of molds mounted on a face wire of a cylinder at intervals in a circumferential direction of said cylinder in said cylinder paper machine, said molds having dimensions corresponding to said window portions and being formed with perforated portions, and said cylinder is used to form said outermost paper layer.

8. The method of making anti-falsification paper as claimed in claim 7, wherein said molds are formed such that a first dimension of each of said molds in a longitudinal direction of said outermost paper layer is 5–30 mm and a second dimension of each of said molds along a widthwise direction of said outermost paper layer is 10–50 mm.

9. The method of making anti-falsification paper as claimed in claim 7, wherein said molds are mounted at intervals along the circumferential direction of said cylinder so that non-window portions are formed between said window portions, and a ratio of a dimension (X) of each of said window portions along the longitudinal direction of said outermost paper layer and a dimension (Y) of each of said non-window portions along the longitudinal direction of said outermost paper layer is 3:1 to 1:2.

10. The method of making anti-falsification paper as claimed in claim 9, wherein said molds are formed such that a first dimension of each of said molds in a longitudinal direction of said outermost paper layer is 5–30 mm and a second dimension of each of said molds along a widthwise direction of said outermost paper layer is 10–50 mm.

11. The method of making anti-falsification paper as claimed in claim 6, wherein said outermost paper layer and said inner paper layer are combined to form a combination ratio of 20:80 to 80:20.

12. A method of making anti-falsification paper using a cylinder paper machine having a plurality of vats, said method comprising:

forming an outermost paper layer in a first vat which is disposed in front of a second vat, said outermost paper layer including window portions arranged at intervals along a longitudinal direction of said outermost paper layer;

forming watermarks in said window portions of said outermost paper layer;

forming an inner paper layer in said second vat after forming said outermost paper layer;

inserting a thread between said outermost paper layer and said inner paper layer such that said thread is exposed through said window portions of said outermost paper layer; and putting together said outermost paper layer and said inner paper layer, after inserting said thread, to form combination paper having at least two paper layers including said outermost and said inner layers, wherein said watermarks are formed in said window portions of said outermost paper layer and said thread is exposed at said window portions.

13. The method of making anti-falsification paper as claimed in claim 12, wherein said watermarks are formed with a plurality of molds mounted on a face wire of a cylinder at intervals in a circumferential direction of said cylinder in said cylinder paper machine, said molds being dimensioned so as to correspond to said window portions and being formed with perforated portions, and said cylinder is used to form said outermost paper layer.

14. The method of making anti-falsification paper as claimed in claim 13, wherein said molds are formed such that a first dimension of each of said molds in a longitudinal direction of said outermost paper layer is 5–30 mm and a second dimension of each of said molds along a widthwise direction of said outermost paper layer is 10–50 mm.

15. The method of making anti-falsification paper as claimed in claim 13, wherein said molds are mounted at intervals along the circumferential direction of said cylinder so that non-window portions are formed between said window portions, and a ratio of a dimension (X) of each of said window portions along the longitudinal direction of said outermost paper layer and a dimension (Y) of each of said non-window portions along the longitudinal direction of said outermost paper layer is 3:1 to 1:2.

16. The method of making anti-falsification paper as claimed in claim 15, wherein said molds are formed such that a first dimension of each of said molds in a longitudinal direction of said outermost paper layer is 5–30 mm and a second dimension of each of said molds along a widthwise direction of said outermost paper layer is 10–50 mm.

17. The method of making anti-falsification paper as claimed in claim 12, wherein said outermost paper layer and said inner paper layer are combined to form a combination ratio of 20:80 to 80:20.

* * * * *